US005261660A

United States Patent [19]

Rowland

[11] Patent Number: 5,261,660

[45] Date of Patent: Nov. 16, 1993

[54] BOWLING BALL WITH THUMB HOLE PAD

[75] Inventor: George Rowland, 5440 Fillmore St., Hollywood, Fla. 33021

[73] Assignees: George Rowland; Brenda Langstaff

[21] Appl. No.: 968,448

[22] Filed: Oct. 29, 1992

[51] Int. Cl.[5] ..... A63B 37/00

[52] U.S. Cl. ..... 473/130

[58] Field of Search ..... 273/63 A, 63 R, 63 B, 273/63 F, 63 G, 64

[56] References Cited

U.S. PATENT DOCUMENTS

| | | | |
|---|---|---|---|
| 2,708,578 | 5/1955 | Mitchell | 273/63 A |
| 2,979,334 | 4/1961 | Mitchell | 273/63 A |
| 4,416,452 | 11/1983 | Heimbigner | 273/63 A |
| 4,432,546 | 2/1984 | Allen, Jr. | 273/63 A |
| 4,530,502 | 7/1985 | Yamane | 273/63 A |
| 4,561,654 | 12/1985 | Haza | 273/63 B |
| 4,569,520 | 2/1986 | Yamane | 273/63 A |
| 4,890,836 | 1/1990 | Goldie | 273/63 A |

*Primary Examiner*—George J. Marlo
*Attorney, Agent, or Firm*—Robert C. Kain, Jr.

[57] ABSTRACT

The thumb pad, in a preferred embodiment, is disposed in the thumb hole of a bowling ball. The pad is a thin, multi-layer, highly flexible pad. A first elongated tape-like layer has an adhesive surface adapted to be adhered to the bowling ball wall defining the thumb hole. The length of the thumb pad does not exceed the depth of the thumb hole. The width of the thumb pad is approximately the width of the backside of the thumb. The backside of the thumb is the side opposite the palm side of the thumb. The thumb pad includes a second elongated tape-like layer overlaying the first tape-like layer opposite the adhesive surface. The second layer has a low friction surface (preferably TEFLON coated) adapted to be positioned adjacent the backside of the thumb. The thumb pad further includes a thin, compressible, foam-like pad interposed between the first and second layers at a position remote from one end of the overlaid first and second layers. The foam pad is positioned remote from the bottom of the thumb hole such that the pad is aligned with a portion of the thumb intermediate the medial knuckle of the thumb and the proximal thumb joint.

5 Claims, 1 Drawing Sheet

BOWLING BALL WITH THUMB HOLE PAD

Background of the Invention

The present invention relates to a thumb pad for a thumb hole in a bowling ball.

U.S. Pat. No. 4,530,502 to Yamane discloses a bowling ball thumb hole insert. The insert includes a semi-cylindrical end piece which fits within a thumb hole of a bowling ball. A non-metallic, plastic, flexible plate is attached to the end piece and extends upward therefrom. The end piece is placed at the bottom of the thumb hole. The flexible plate is curved such that it forms an interspace between the wall of the thumb hole and the inner surface of the plate. The outer surface of the plate, which is convexly curved, rests against the back of the bowler's thumb. Yamane also discloses a device which is cylindrically shaped. The cylindrical insert has two longitudinally extending slots therein. These slots define a semi-cylindrical shape. The semi-cylindrical portion of the insert has a cushioning pad disposed between the outside of the insert near the wall of the thumb hole and the hard inner wall defining the semi-cylindrical insert portion. The bowler's thumb rests against the hard inside surface of the insert. U.S. Pat. No. 4,569,520 to Yamane discloses a similar thumb insert.

U.S. Pat. No. 4,416,452 to Heimbigner discloses a bowling ball finger grip insert. The insert is tubular in shape and consists of an inner resilient sleeve disposed at the bottom of the insert (at a position near the bottom of the finger hole of the bowling ball) and an outer hard sleeve. The distal end of the bowlers finger, particularly the finger pad, is placed adjacent or next to the resilient sleeve. The distal joint of the finger is disposed above the resilient sleeve and next to the hard outer sleeve.

U.S. Pat. No. 4,561,654 to Haza discloses a device for adjusting the diameter for bowling balls. U.S. Pat. No. 4,890,836 to Goldie discloses a bowling ball insert which is made of a cylindrical tube of resilient material. The insert is cylindrical in shape and is molded of a silicone having a Shore hardness of 50. A ballast is provided at the distal end or the bottom of the cylindrical insert. By adjusting the weight of the ballast, the balance of the bowling ball is adjusted.

U.S. Pat. No. 4,432,546 to Allen, Jr. discloses a finger insert for bowling balls. The insert is generally cylindrical in shape and includes a series of corrugations or ribs which extend horizontally about the interior surface of the cylindrical insert. The ribs cushion the pads of the bowler's fingers during use. The insert is thick near the top surface of the finger hole and gradually decreases in thickness near the bottom of the finger hole. The pads of the bowler's finger tips contact the ribs of the insert, not the back side of the fingers.

None of these prior art devices provided a cushion for the backside of a bowler's thumb intermediate the medial knuckle of the thumb and the proximal thumb joint which attaches the thumb to the bowler's hand.

Objects of the Invention

It is an object of the present invention to provide a thumb pad for a bowler's thumb which provides a cushion immediately beyond the medial knuckle of the thumb and intermediate the medial knuckle and the proximal thumb joint.

It is another object of the present invention to provide a thumb pad which enables the user to easily grip the bowling ball.

It is a further object of the present invention to provide a thumb pad which reduces, and in some cases, eliminates the callus formed on the medial knuckle of a bowler's thumb.

It is an additional object of the present invention to provide a low friction surface for the entire back side of the bowler's thumb.

Summary of the Invention

The thumb pad, in a preferred embodiment, is disposed in the thumb hole of a bowling ball. The pad is a thin, multi-layer, highly flexible pad. A first elongated tape-like layer has an adhesive surface adapted to be adhered to the bowling ball wall defining the thumb hole. The length of the thumb pad does not exceed the depth of the thumb hole. The width of the thumb pad is approximately the width of the backside of the thumb. The backside of the thumb is the side opposite the palm side of the thumb. The thumb pad includes a second elongated tape-like layer overlaying the first tape-like layer opposite the adhesive surface. The second layer has a low friction surface adapted to be positioned adjacent the backside of the thumb. The thumb pad further includes a thin, compressible, foam-like pad interposed between the first and second layers at a position remote from one end of the overlaid first and second layers. The foam pad is positioned remote from the bottom of the thumb hole such that the pad is aligned with a portion of the thumb intermediate the medial knuckle of the thumb and the proximal thumb joint.

Brief Description of the Drawings

Further objects and advantages of the present invention can be found in the detailed description of the preferred embodiments when taken in conjunction with the accompanying drawings in which.

Detailed Description of the Preferred Embodiments

The present invention relates to a thumb pad for a bowling ball thumb hole.

Figure 1:
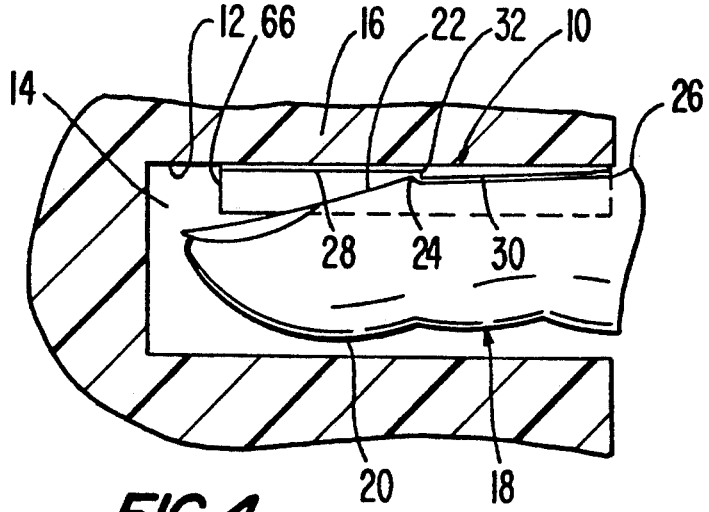
FIG. 1 diagrammatically illustrates a bowler's thumb inserted into a thumb hole and the positioning of the thumb pad in the thumb hole and particularly the positioning of the compressible foam-like pad in the thumb pad.

FIG. 1 illustrates thumb pad 10 disposed on the interior side wall 12 defining a thumb hole 14 of a bowling ball which is shown in cross section as bowling ball portion 16. Thumb 18 is also disposed in thumb hole 14. Thumb 18 includes a palm side 20 and a backside 22 opposite palm side 20. Thumb 18 includes a medial knuckle 24 and a proximal thumb joint 26 which attaches the thumb to a bowler's hand. Thumb pad 10 includes a thin, distal portion 28 and a slightly thicker foam pad portion 30. The distal end 32 of foam pad portion 30 is located longitudinally behind medial knuckle 24 of thumb 18. Further, foam pad portion 30 is positioned laterally intermediate medial knuckle 24 and proximal thumb joint 26. As used herein, the term "longitudinal" refers to the length of the thumb or thumb pad 10 (also the depth of hole 140, and the term "lateral" refers to a dimension or alignment perpendicular to the longitudinal aspect of an item. The diameter of hole 14 is one lateral aspect of the hole.

It is known that the medial knuckle of some bowler's develop calluses due to rubbing of the knuckle on the interior side of a bowling ball thumb hole. These calluses and the friction developed between the back side of the thumb and the interior surface of the thumb hole distracts the bowler and affects the bowler's ability to control the bowling ball during the swing and release of the ball down the alley. The placement of a cushioning pad in a thumb insert intermediate the medial knuckle and the proximal thumb joint enables the bowler to better grip the bowling ball, reduces the friction between the bowler's thumb and the thumb hole, and further reduces and sometimes eliminates the callus formed on the medial knuckle of the bowler's thumb.

Figure 2:
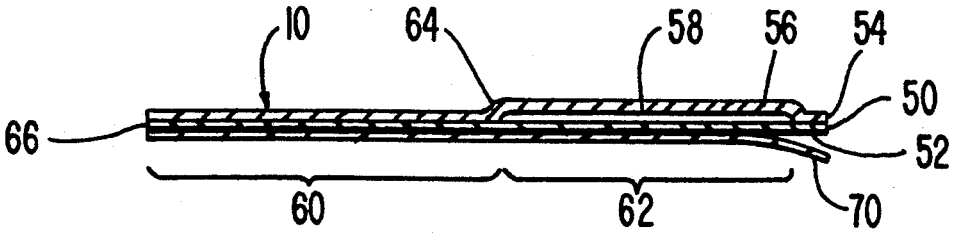
FIG. 2 diagrammatically illustrates the various layers of the thumb pad.

FIG. 2 illustrates a cross section of thumb pad 10. A first elongated tape-like layer 50 has an adhesive surface 52 which enables the thumb pad to adhere to wall 12 defining thumb hole 14. A second elongated tape-like layer 54 complete st layer 52. Second layer 54 has a low friction outer surface 56 having a low coefficient of friction such that the bowler's thumb easily slides over the entire layer and, hence, the entire pad. A thin, compressible, foam-like pad 58 is interposed between the first and second layers 50, 54. Accordingly, the thumb pad includes a thin multi-layer, tape-like structure in region 60 and a thicker compressible foam pad portion in region 62. Foam pad 58 has a distal end 64 that is remote from distal end 66 of pad 10. Distal end 66 is positioned near the bottom of thumb hole 14 as shown in FIG. 1. The distal end 64 of foam pad portion 62 is disposed beyond medial knuckle 24 and intermediate that knuckle and proximal thumb joint 26. Additionally, thumb pad 10 may include a releasable tape-like layer 70 which is removed to expose adhesive surface 52 of first layer 50 during use. As shown in FIG. 2, the proximal end of releasable layer 70 has been separated from first layer 65 thereby exposing adhesive surface 52.

Figure 3:
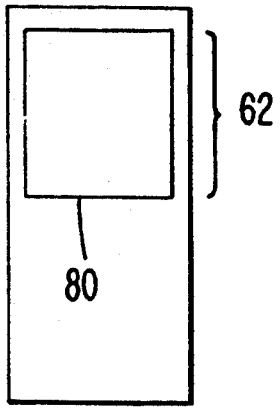
FIG. 3 diagrammatically illustrates the location of the compressible foam-like portion of the thumb pad and the overlaid first and second layers of the pad; and, FIG. 4 diagrammatically illustrates a thumb pad having two foam pads therein.
Figure 4:
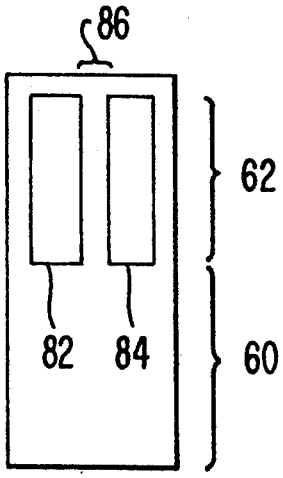

FIGS. 3 and 4 show different types of configurations for foam pad portion 62. In FIG. 3, foam pad 80 is rectangular in shape and covers a substantial portion of region 62. In FIG. 4, the foam pad has been longitudinally that two rectangular foam pads 82, 84 are laterally aligned and separated by a space thickness or longitudinal channel 86. The thickness of the pad at space 86 is equivalent to the thickness of the pad at distal end region 60. Of course, the multiple foam pads could be utilized has long as they are laterally aligned and as long as the distal ends of the foam pads do not extend past the medial knuckle of the bowler's thumb, that is, do not approach the nail on the back side of the bowler's thumb.

In one working embodiment, the first layer has been made of two sided mounting tape manufactured by 3M Corporation. The foam pad is also manufactured by 3M as mounting tape. Low friction surface 56 is generally a TEFLON-type surface. If a full rectangular foam pad is used a shown in FIG. 3, when the pad is curved during insertion into the cylindrical hole of the bowling ball, the foam pad creases generally about its mid-section. The split foam pad configuration shown in FIG. 4 does not crease due to space 86 intermediate laterally aligned foam pads 82 and 84. The length of the thumb pad can be as small as ½ inch and may be as large as 2½ inches depending upon the depth of the thumb hole. The width of the thumb pad can be as small as ⅛ inch and as large as 1 inch depending on the diameter of the thumb hole. Sometimes, the callus formed on the bowler's medial knuckle is called a "bowler's knot". The split pad configuration shown in FIG. 4 may be useful to provide a space for the bowler's knot during the release of the bowling ball. It has been found that the use of the thumb pad in accordance with the principles of the present invention prevents or eliminates loss of control of the ball during the swing and release of the ball. The bowler has a better feel of the ball and the bowler need not squeeze the ball as tightly due to the presence of the foam portion acting on the back side of the thumb beyond the medial knuckle. Since the bowler holds the ball with less pressure, the bowler has better control, accuracy and consistency in his or her delivery of the bowling ball down the alley. The claims appended hereto are meant to cover modifications and changes within the scope and spirit of the present invention.

What is claimed is:

1. A bowling ball and thumb pad combination comprising:

a bowling ball having a thumb hole therein, said thumb hole having a depth which accommodates a bowler's thumb, said bowler's thumb having a palm side, a back side opposite said palm side, a medial joint with a medial knuckle on the back side of said thumb, and a proximal thumb joint which attaches the thumb to a bowler's hand;

a thumb pad for insertion into said thumb hole, said thumb pad including:

a thin, multi-layer, highly flexible pad having a first end which is inserted into the depths of the thumb hole and a second end which is disposed near the top of the thumb hole, said multi-layer pad having:

a first elongated thin layer having an adhesive surface adapted to be adhered to a bowling ball wall defining said thumb hole;

a second elongated thin layer overlaying said first layer opposite said adhesive surface, said second layer having an exposed surface with a low coefficient of friction adapted to be positioned adjacent said back side of said thumb; and, a thin compressible foam pad interposed between said first and second layers at a position spaced away from said first end of said multi-layer pad such that said foam pad is laterally aligned with a portion of said thumb intermediate said medial knuckle and said proximal thumb joint and si positioned in a medial region of said thumb hole, the resulting composition structure of first and second layers and intermediate foam pad forming a multi-layer compressible pad region having a uniform thickness throughout its length, said compressible pad region extending from said medial region of said thumb hole to an upper region thereof, said foam pad in its entirety being completely secured between said first and second layers.

2. A combination bowling ball and thumb pad as claimed in claim 1 wherein said compressible foam pad region having a first and a second longitudinal foam pad end, said first foam pad end being remotely located and spaced away from said first end of said thumb pad and said first pad end being longitudinally disposed beyond said medial knuckle opposite a distal end of said thumb.

3. A combination bowling ball and thumb pad as claimed in claim 2 wherein said thin, multi-layer, flexible pad has a width which corresponds to the width of said back side of said thumb.

4. A combination bowling ball and thumb pad as claimed in claim 3 including a releasable thin layer disposed on said adhesive surface of said first layer, said releasable layer adapted to be removed thereby exposing said adhesive surface during use of said pad.

5. A combination bowling ball and thumb pad as claimed in claim 1 wherein said foam pad includes two foam pads which are laterally aligned but are further laterally separated to form a shallow longitudinal channel therebetween, the first foam pad ends of each aligned foam pad being positioned longitudinally in a medial region of said thumb hole beyond said medial knuckle opposite a distal end of said thumb.

* * * * *